United States Patent [19]

Allington et al.

[11] Patent Number: 4,673,334

[45] Date of Patent: Jun. 16, 1987

[54] PERISTALTIC PUMP

[75] Inventors: Robert W. Allington; John D. Hull, both of Lincoln, Nebr.

[73] Assignee: Isco, Inc., Lincoln, Nebr.

[21] Appl. No.: 825,690

[22] Filed: Feb. 3, 1986

Related U.S. Application Data

[63] Continuation of Ser. No. 614,331, May 25, 1984, abandoned.

[51] Int. Cl.[4] ..... F04B 43/12

[52] U.S. Cl. ..... 417/53; 417/475; 417/477

[58] Field of Search ..... 417/474–477, 417/53

[56] References Cited

U.S. PATENT DOCUMENTS

| | | | |
|---|---|---|---|
| 2,804,023 | 8/1957 | Lee | 417/477 |
| 3,366,071 | 1/1968 | Dutler | 417/477 |
| 3,723,030 | 3/1973 | Gelfand | 417/477 X |
| 3,791,777 | 2/1974 | Papoff et al. | 417/475 |
| 3,927,955 | 12/1975 | Spinosa et al. | 417/477 |
| 4,025,241 | 5/1977 | Clemens | 417/477 |
| 4,189,286 | 2/1980 | Murry et al. | 417/477 |
| 4,211,519 | 7/1980 | Hogan | 417/477 X |
| 4,473,342 | 9/1984 | Iles | 417/477 X |

FOREIGN PATENT DOCUMENTS

| | | | |
|---|---|---|---|
| 100309 | 9/1973 | German Democratic Rep. . | |
| 82/04291 | 12/1982 | PCT Int'l Appl. | 417/475 |
| 1383858 | 2/1975 | United Kingdom | 417/475 |
| 2076476 | 12/1981 | United Kingdom . | |
| 2094410 | 9/1982 | United Kingdom . | |

*Primary Examiner*—John J. Vrablik

*Attorney, Agent, or Firm*—Vincent L. Carney

[57] ABSTRACT

To increase precision of flow in multiple channels of a peristaltic pump, a plurality of spring biased cassettes are mounted to cooperate with a spool having a plurality of elongated rollers which orbit about its center so that each elongated roller in succession compresses a plurality of flexible tubes in the channels against corresponding cam surfaces in the cassettes, spaced from the rollers by surfaces of the cassettes which are in contact with the rolles. In each cassette, the cam is mounted between side plates against which the rollers roll, which are spring biased against the rollers and hinged at a center location to provide precision determined only by the precision of the cam to side plate edge dimension. The cam is shaped to reduce pulses during roller lift-off from the cam surface to provide for pulse-free flow.

25 Claims, 5 Drawing Figures

PERISTALTIC PUMP

This application is a continuation of application Ser. No. 614,331, filed May 25, 1984, now abandoned.

BACKGROUND OF THE INVENTION

This invention relates to peristaltic pumps.

In one class of peristaltic pumps such as that disclosed, for example, in U.S. Pat. No. 3,366,071 to Dutler granted Jan. 3, 1963, a plurality of rollers are orbited about a central driving shaft and compress a tube, with the rollers rolling against a bearing surface to control the amount of compression of the flexible tube.

In a prior art unit of this type, the rollers are in the form of cylinders, each having two steps of diameter. The inner step of the roller cylinders is radially compliant, fits within a substantially circular crosssectional compartment and is traction driven by a central axle to follow an orbit along the roughly circular path. The outer step of the roller cylinders extends into a circumferential slot in the roughly circular crosssectional compartment and compresses the flexible tube therein to pump the fluid.

This type of peristaltic pump has several disadvantages such as: (1) it is difficult to machine the radially compliant rollers with sufficient precision; (2) it works best as a single-channel pump and is clumsy to use as a multiple-channel pump; and (3) it is difficult to adjust the pump to different size conduits or for different pumping configurations.

Another type of peristaltic pump includes a plurality of cassettes rigidly holding tubes to rollers and having gearing on the rollers to provide forced backspin for preventing stretch of the tube from the drive of the orbiting rollers, for reducing the tendency of the tube to crawl through the cassette and for reducing pulses due to the stretching. This prior art pump has the disadvantage of being expensive to make with the tolerances necessary for: (1) low fluid pulsation; (2) long tubing life; and (3) pressure capability limited only by the strength of the tubing.

Other prior art peristaltic pumps orbit rollers about a central shaft but do not include a support for the rollers that is independent of the drive and which controls the tube. This type of prior art peristaltic pump has several disdvantages such as: (1) the flow rate and fluid pressure change with temperature and wear; (2) it is difficult to manufacture for precision flow rate and cancellation of fluid pulsation because the cumulative effect of machining tolerances extend from the center of the drive shaft to the rollers, the flexible tube and the fixed support for the tube; and (3) for similar reasons, it is difficult to match a plurality of channels.

SUMMARY OF THE INVENTION

Accordingly, it is an object of the invention to provide a novel peristaltic pump.

It is a further object of the invention to provide a novel cassette for a peristaltic pump.

It is a further object of the invention to provide a novel cassette for a multiple channel peristaltic pump.

It is a still further object of the invention to provide a novel self-adjusting cassette for cassette type peristaltic pumps.

It is a still further object of the invention to provide a multiple channel peristaltic pump which requires no user adjustments to provide channel-to-channel calibration accuracy.

It is a still further object of the invention to provide a novel multiple channel peristaltic pump not requiring closely toleranced manufacturing parts or an elaborate assembly and factory adjustment procedure to provide precision in pumping.

It is a still further object of the invention to provide a peristaltic pump in which the tubes may be easily changed without requiring substantial adjustment when the new tube is installed.

It is a still further object of the invention to provide a peristaltic pump which is capable of accommodating more than one bore of tubing while maintaining non-pulsing flow.

It is a still further object of the invention to provide a novel peristaltic pump utilizing a single spool of rollers to drive a plurality of channels which may be individually attached or detached without stopping the pump.

It is a still further object of the invention to provide a cassette-type peristaltic pump in which each cassette possesses multiple degrees of freedom which allows it to simultaneously follow the trajectory of several orbiting rollers without recourse to expensive, high precision fabrication and assembly.

It is a still further object of the invention to provide a novel peristaltic pump having a center-hinged cassette in which a cam is biased against the rollers.

In accordance with the above and further objects of the invention, a cassette for a peristaltic pump is provided having spring means for engaging the drive means of a peristaltic pump with a biasing force to permit it to be self-adjusting. The cassettes have a support surface and a cam surface whereby flexible tubes may be pressed between the rollers of the pump and the cam surface. The support surface engages the rollers and spaces the tube a predetermined distance from the rollers, whereby a programmed amount of compression may be provided.

Advantageously, the programmed sequence is such that compression of fluid is maintained at a level which does not cause a spurt or pulsation. In an embodiment with cassettes having three degrees of freedom of movement, more than three rollers do not engage the entire cam surface at the same time since this could lift the cam surface from one roller even if it is spring biased. To prevent pressure surges in one embodiment, two rollers do not completely close the tubing until the lagging roller does so just before the leading roller begins to lift away from a complete closing of the tube in a programmed sequence to release fluid from the outlet end. In another embodiment, the lagging roller compresses the tube well beyond closure just before the reference point at which the leading roller begins to open the tube. Continuing onward, the lagging roller gradually recompresses the tube to a short period of complete closure, after which it then begins to open the tube when it too reaches the said reference point.

The cassettes are adapted to mount over side-by-side elongated rollers which are each mounted for orbital motion about a central drive axle and rotation about its own longitudinal axis of rotation. The rollers are driven in the orbital motion and rotate against two side plates with the tube resting against a cam surface within each cassette. In one embodiment, the cassettes are formed in two parts, hinged at their center, to be pulled resiliantly downwardly and have spring clamps at their ends which engage the housing of the pump to be self-adjusting and force the cassettes downwardly against the rollers. This embodiment has three degrees of freedom of movement at the cassette: (1) side-to-side; (2) up and down; and (3) flexion about the central hinge.

The rollers rotate freely about their own axis and are rotated by the contact with the edge of the side plates during orbiting. They are sufficiently long to accommodate a plurality of cassettes, each for supporting one or more tubes to provide a plurality of channels which require no adjustment with respect to each other for accuracy in flow rate. The cams may also be changed or adjusted on each cassette to provide different programmed sequences or to accommodate different wall-thicknesses and materials of walls of flexible tubes.

From the above description it can be understood that the peristaltic pump of this invention has several advantages, such as: (1) cassettes may be removed or added without stopping the pump; (2) it provides a simple mechanism for adjusting a pump; (3) it is an easily manufactured, precise pump; (4) it is a relatively pulse-free pump which can accommodate relatively large diameter tubes; and (5) the compression of tubes can be programmed to follow a predetermined sequence for purposes such as the elimination of pulsation at either the inlet, the outlet or both.

SUMMARY OF THE DRAWINGS

The above noted and other features of the invention will be better understood from the following detailed description when considered with reference to the accompanying drawings in which.

DETAILED DESCRIPTION

Figure 1:
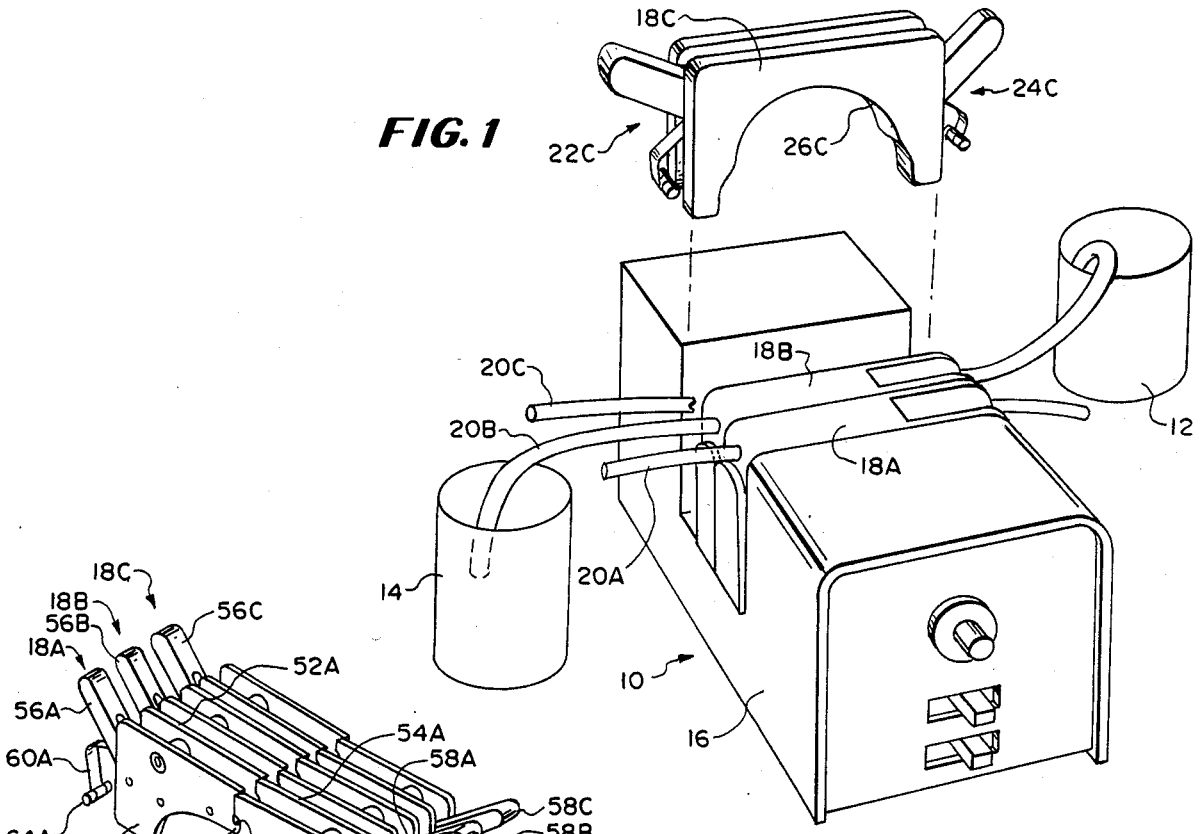
FIG. 1 is a simplified, fragmentary perspective view, partly exploded, illustrating an embodiment of the invention.

In FIG. 1 there is shown a simplified perspective view of a pumping system including a peristaltic pump 10, a first container 12 and a second container 14 arranged so that the pump 10 may pump a liquid from one of the containers to the other or may draw fluid out of one of the containers through one end of the tube and hold it until that end is moved to another container and the pump reversed for expelling it.

The pump 10 includes a cabinet or housing 16, three cassettes 18A–18C, one of which is shown removed and three tubes 20A–20C positioned within the pump 10. The cabinet 16 encloses programmable control circuitry, a motor and pump drive circuitry which cooperate with the cassettes 18A–18C and the tubes 20A–20C in programmed pumping operations. The cabinet 16, motor and drive mechanisms are not part of this invention and are typical of equivalent devices in the prior art.

The cassettes 18A–18C are identical and include a spring biasing means shown at 22C for cassette 18C on one end and a second spring biasing means 24C on the other end. The spring biasing means 22C and 24C bias a cam surface means 26C downwardly toward the rollers to control the amount the tubes 20A–20C are squeezed in a programmed manner which reduces pulsations in a manner to be described hereinafter.

Figure 2:
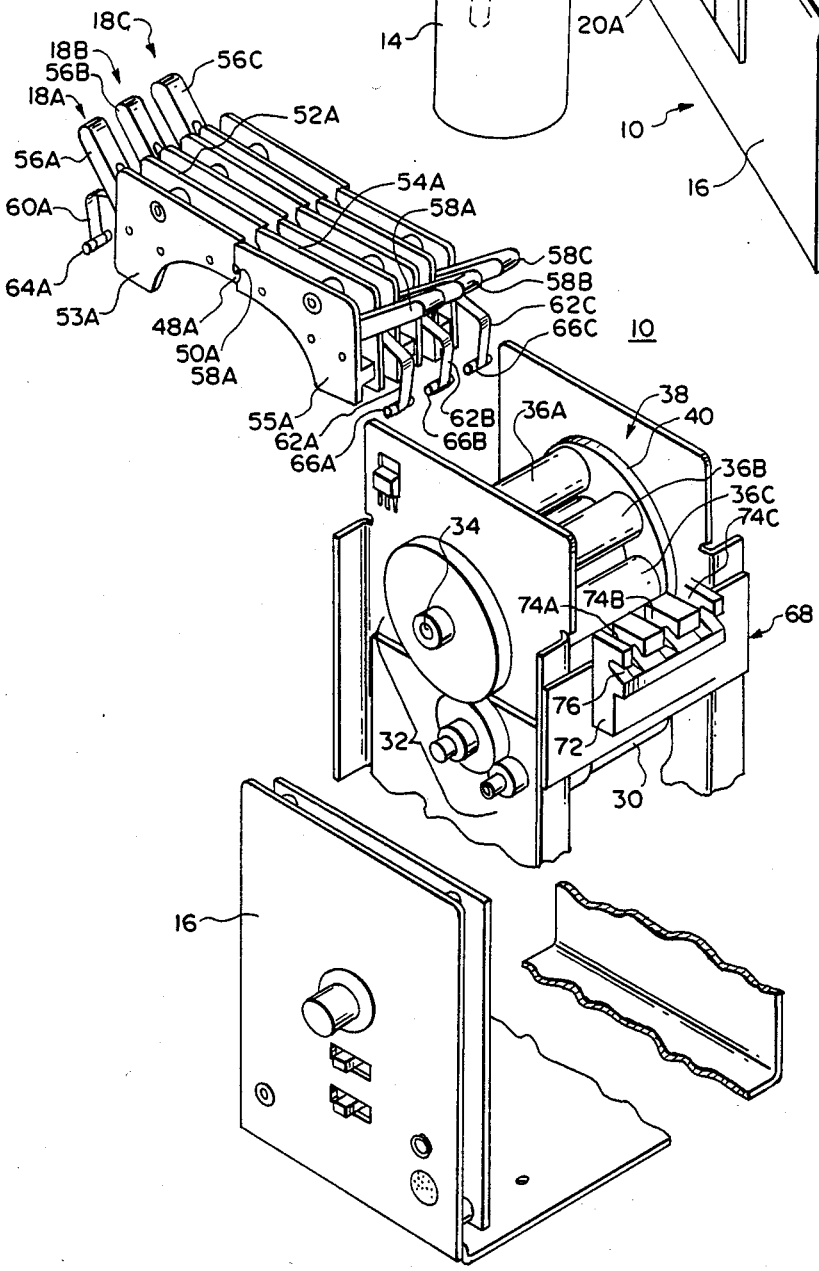
FIG. 2 is a fragmentary, exploded perspective view illustrating the embodiment of FIG. 1 in greater detail.

In FIG. 2 there is shown a simplified, fragmentary, exploded perspective view of a portion of the pump 10 having a motor 30, a transmission 32, a spool 38 and the cassettes 18A–18C. The cassettes 18A–18C are shown positioned to cooperate with respective ones of the tubes 20A–20C (not shown in FIG. 2 but shown in FIG. 1) and the spool 38. The spool 38 is driven by the motor 30 through the transmission 32 which in turn drives the axle 34 of the spool 38.

The spool 38 includes a plurality of rollers, three of which are shown at 36A–36C, each of the rollers being rotatably mounted to a different one of two spool flanges, one of which is shown at 40. The spool flanges are mounted for rotation with the axle 34 that is driven through the transmission 32 by the motor 30. The rollers such as 36A–36C are mounted to the flanges for orbiting about the axle 34 and rotating within the spool flanges so as to cooperate with the flexible tubes 20A–20C (not shown in FIG. 2 but shown in FIG. 1).

To hold the flexible tubes 20A–20C (not shown in FIG. 2 but shown in FIG. 1) over the spool 38 so that the rollers such as those shown at 36A, 36B and 36C can compress them to force fluid therethrough, the cassettes 18A–18C each have parts which are adpated to flexibly mount over the spool 38. Only the cassette 18A will be described in detail but the cassettes 18B and 18C are identical and the corresponding numbered parts on the cassettes 18B and 18C are identical to those on cassette 18A but are adapted to cooperate with different ones of the flexible tubes 20A–20C (not shown in FIG. 2 but shown in FIG. 1).

To flexibly mount over the spool 38, the cassette 18A has a hinge boss 48A, a hinge pin 50A, pairs of parallel inlet side plates 53A and 52A and outlet side plates 55A and 54A, inlet and outlet side locking levers 56A and 58A respectively, and inlet and outlet side latching springs or side latches 60A and 62A respectively. The side plates 53A, 52A, 55A and 54A are pivotally mounted by the pin 50A passing through the hinge boss 48A and spring biased in a manner to be described hereinafter. When the cassettes 18A–18C are placed over the spool 38, the locking levers 56A–56C, 58A–58C and the side latching springs cooperate together to hold the cassettes in place and provide properly controlled camming surfaces for rollers 36A–36C (others are shown in FIG. 3) and for the flexible tubes 20A–20C (not shown in FIG. 2 but shown in FIG. 1).

To hold the cassettes 18A–18C in place over the spool 38, the inlet side latching springs and the outlet side latching springs such as those shown at 60A and 62A–62C each have mounted at their end a corresponding one of the cassette pin latches 64A, 66A, 66B and 66C. On opposite sides of the spool 38, there are mounted to the cabinet 16 of the pump 10, cassette clip keepers, one of which is shown at 68 adapted to receive and hold the cassette pin latches. The two cassette clip keepers are identical and only the cassette clip keeper 68 will be described in detail.

The cassette clip keeper 68 includes a base 72, tangentially-extending spring slots 74A–74C and a cross slot 76. The base 72 extends radially outwardly from the spool 38 (horizontal in FIG. 2) and the tangentially extending spring slots 74A–74C are positioned to extend orthogonal to the axis of the cassettes 18A–18C respectively. They extend part way through the base 72 to receive the outlet side latches 62A–62C. The slots have a dimension parallel to the axle 34 which is sufficient to accommodate the side latching springs 62A–62C respectively but not sufficient to accommodate the pin latches 66A–66C respectively. The cross slot 76 is orthogonal to the spring slots 74A–74C and intersects them to form a keeper slot capable of receiving the ends of the latch pins 66A–66C to be held in place by outstanding fingers formed in the base 72 by the slots 74A–74C and the cross slot 76.

Figure 3:
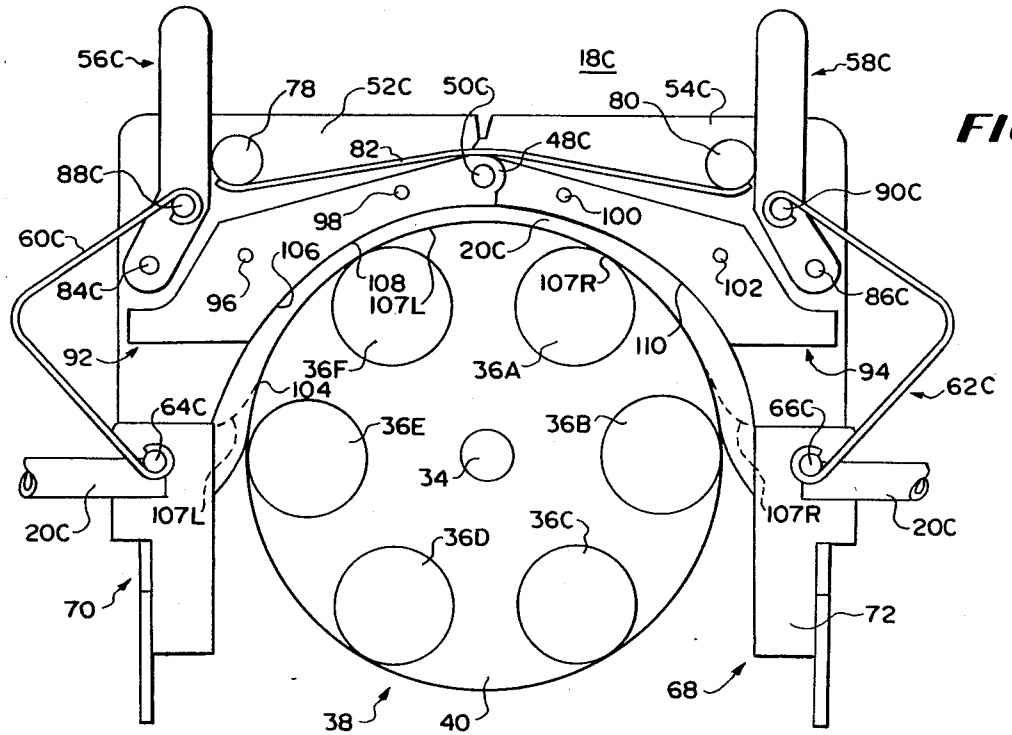
FIG. 3 is an elevational view illustrating a portion of the embodiment of FIG. 1.

In FIG. 3 there is shown an elevational view of a portion of the cassette 18C mounted on the spool 38. Only 52C of the two parallel inlet side plates 53C–52C and 54C of the two outlet side plates 54C is shown to permit a clearer illustration of the manner in which the flexible tube 20C is compressed by the rollers 36A–36F as the spool 38 rotates to force fluid through the flexible tube 20C.

Although only one cassette 18C is shown, the other cassettes cooperate in the same manner with the spool 38 to: (1) provide self-adjustment between the rollers 36A–36F and the inlet side plate 52C and outlet side plate 54C for uniform action against all of the flexible tubes with all of the cassettes at all times by automatic adjustment of pressure; and (2) to provide a controlled sequence of the degree of squeezing of the tube 20C by the rollers 36A–36F based on their position and thus reduce pulsations.

To provide for self-adjustment of pressure, the biasing means includes three biasing means, a first of which includes the inlet side locking lever 56C and the inlet side latching spring 60C, a second of which includes a first pin 78, a second pin 80 and a center leaf spring 82 and a third of which includes the outlet side locking lever 58C and outlet side latching spring 62C.

To support the leaf spring 82, the pins 78 and 80 extend orthogonally to the inlet side plate 52C and outlet side plate 54C respectively. The pins 78 and 80 are positioned near the corners of the side plates, distant from the hinge pin 50C and the spool 38 but toward the hinge pin from the locking levers 56C and 58C. They extend between the two parallel inlet side plates, only one of which is shown at 52C in FIG. 3, and the outlet side plates, only one of which is shown at 54C in FIG. 3, and hold the two inlet side plates and outlet side plates in parallel relationship to encompass within them the locking levers and springs.

To provide a center biasing force to bias the side plates away from the spool 38 when releasing side plates from the spool 38 and to bias against the stiffer inlet side spring 60C and the stiffer outlet side spring 62C when they are holding the side plates against the spool 38, the less stiff center leaf spring 82 extends parallel to the inlet and outlet side plates 52C and 54C with its center resting on the top of the hinge pin 50C, one end extending underneath the pin 78 and the other underneath the pin 80. This center spring 82 provides a biasing force to rotate the side plates about the hinge pin 50C away from the spool 38 and to bias their outer ends upward against the stronger forces of the inlet side spring 60C and outlet side spring 62C when the cassettes are mounted to the spool 38.

To lock the cassette 18C against the rollers in the spool 38, and squeeze the flexible tube 20C, the inlet and outlet sides utilize the locking levers and springs in the same manner so that only the inlet side will be described in detail with the understanding that the outlet side includes corresponding parts which lock in the same manner.

The inlet side locking lever 56C has a pin 84C at its lower end about which it pivots and the outlet side locking lever 58C has a similar pin 86C at its lower end for similar pivoting. The levers are generally bifurcated at their lower ends and have their respective inlet and outlet side springs 60C and 62C, lying within the bifurcation of the levers, pivotally mounted at one end about pivot pins 88C and 90C with the levers having an angle in them to form a toggle about that point. The angle is obtuse in the outward direction away from the spool 38 and of approximately 135 degrees. The levers may pivot toward the hinge pin 50C until the top portions are vertical and rest against the pins 78 and 80 respectively or pivot downwardly so their top portion is pointing down from a horizontal line so as to be almost tangential in direction with the spool 38.

To form toggles, the inlet side spring 60C and the outlet side spring 62C are each bent at approximately a right angle to itself in a direction that causes: (1) the pin 88C and latching pin 64C at opposite ends of the inlet side spring 60C to be bent close to each other on the side facing spool 38; and (2) similarly the pin 90C and the latch pin 66C are closer to each other on the side facing spool 38.

To bias the locking lever 56C with its top portion against the pin 78 with the spring 82, the pivot pin 84C is positioned in a line with the cassette clip keeper 70 and the pin 88C so that when the upper end of lever 56C is rotated to its most vertical position, the pin 88C is closer to the spool 38 and beyond the vertical line between the pivot pin 84C and latch pin 64C within the cassette clip keeper 70.

Similarly, when the lever is pulled downwardly so that it rotates counter-clockwise about the pivot pin 84C shown in FIG. 3, the inlet side spring 60C, once the pin 88C passes to the left of the line between the pivot pin 84C and the pin 64C within the cassette clip keeper 70, is pulled downwardly to loosen the lock.

The latch works in the same manner on the opposite side of the cassette 18C so the levers may be rotated together about the spool 38 with the latch pins 64C and 66C within the cassette clip keepers 68 and 70 and be locked in that place to resiliantly bias the inlet side plate 52C and the outlet side plate 54C about the spool 38. When the locking levers are rotated away from each other, they loosen the spring so as to loosen the toggles that bias the cassette against the spool 38.

To provide precision in the amount of squeezing of the flexible tube 20C as the rollers 36A–36C rotate with the cassette in place, each half of the cassette has two surfaces of differing radii which cooperate with the rollers 36A–36F of the spool 38 to control the amount of tube squeezing. The first surface rests upon the rollers and controls the space between the rollers and the second surface. The second surface provides a bearing support for the tubing to cooperate with the rollers for controlling the amount of squeeze of the flexible tube 20C.

In the embodiment of FIG. 3, the first surface is made up of 107L and 107R, which is formed by the bottom edges of the inlet and outlet side plates 52C and 54C. The first surface is biased by the springs into a close engagement with the rollers to maintain the position of the first surface against the rollers. The second surface is provided by the face 108 of the inlet side cam 92 and the face 110 of the outlet side cam 94.

To hold the inlet and outlet side cams 92 and 94 and the inlet and outlet side plates 52C and 54C in close relationship, the hinge pin 50C passes through a conforming aperture in the outlet side plate 54C and the inlet cam 92. The inlet side plate 52C has the second surface, the curved portion 108 of cam 92, fastened to it so that it is mounted for rotation about the hinge pin 50C in the outlet side plate 54C. Thusly, the curved portion 108 conforms to a second surface about the hinge pin 50C. The outlet cam 94 has a curved portion 110 conforming to a curved second surface around the hinge pin 50C in the inlet cam 92.

The inlet cam 92 is rigidly mounted to the inlet side plate 52C by pins 96 and 98 and the outlet cam 94 is mounted to the outlet side plate 54C by orthogonal pins 100 and 102. Alternatively, cams 92 and 94 may each be respectively molded in one piece with the side plates 52C and 54C. The bottom sides of the inlet and outlet cams 92 and 94 are shaped to provide different amounts of squeezing to the flexible tube 20C and are sufficiently wide so that the tube 20C may rest and be compressed between the rollers 36A–36F and the cams 92 and 94 while remaining between the side plates on both sides of each cam. For this reason, there is a relatively wide surface on the inlet cam 92 between the parallel inlet side plate 52C and its parallel inlet side plate 53C not shown in FIG. 3 and a relatively wide surface on the outlet cam 94 between the outlet side plate 54C and its parallel outlet side plate 55C not shown in FIG. 3.

The positioning of the rollers a controlled distance from the second surface formed by inlet and outlet cams 92 and 94 by the first surface formed by the edge of the side plates 52C and 54C permits precision because there are only two immediately-connected surfaces to be controlled with respect to each other. This is true because the three degrees of freedom provided by the spring biasing means 22C and 24C maintain the first surfaces 107L and 107R referred to as guide surfaces from time to time. of the inlet and outlet side plates 52C and 54C against either two or three of the rollers and only the distance between the first-surface edge of the side plates to the tube-bearing second surfaces 108 and 110 referred to as cam surfaces from time to time of the inlet and outlet cams 92 and 94 controls the amount of squeezing of the tube (the spring means includes latch means to impart two degrees of freedom which are up-down and side-to-side motion, and the hinge means imparts a third degree of motion to the tube holding means, which is pivoting rotation about the hinge).

The amount of squeezing of the tube is controlled so that on the inlet side, the rollers start to contact the tube 20C and the first surface at a location such as 104 which is less than 90 degrees from the hinge. The corresponding point on the outlet side, on the other side of the hinge, is also less than 90 degrees from the hinge. Thus, no more than three rollers can contact the first surface and the tube at a time, and the three available degrees of freedom of motion of the cassette insure that no roller inadvertantly leaves the surface and puts an incorrect squeeze on the tube. As many rollers can simultaneously contact the first surface of the cassette as there are degrees of freedom of motion of the cassette.

The roller compresses the tubing against the inlet cam 92 at its inner surface 106 approximately 63 degrees from the hinge pin 50C and barely occludes the tube against the cam surface 108 of the inlet cam 92. At this location the distance between the guide (first) surface and the cam (second) surface is equal to twice the thickness of the walls of the tube to form a liquid tight seal provided the pressure difference across the occlusion is very small.

The difference in the dimensions between the first and second surfaces varies with the amount of pressure and for a pumping pressure of 30 psi (pounds per square inch) twice the thickness of the tube walls is approximately 126 mils; and the distance between the cam surface and the edge of the side plates closes 25 percent more than this to approximately 94 mils at a point of 59 degrees. This super-occlusion or compression of the elastomeric walls of the tube remains until approximately 5 degrees beyond the hinge point 50C where the tube is compressed against the surface 110 of the outlet cam 94 and then the roller begins a controlled release which reduces pulsations by providing compensation for volume until it is approximately 64 degrees of arc beyond the hinge pin 50C.

The end-to-end symmetry of the means for mounting the cassette onto the rest of the pump provides versatility. Each of the cassettes can be taken off the pump, turned end-to-end and remounted on the pump. The cassette, in one embodiment, has the lower pulsation at the end with cam 94, which is described above as being the outlet. If one of the cassettes is reversed, the inlet of the cassette has the lower pulsation. If the direction of rotation is reversed, then the reversed cassette has the lower pulsation at its outlet and the unchanged cassettes have the lower pulsation inlets.

Figure 4:
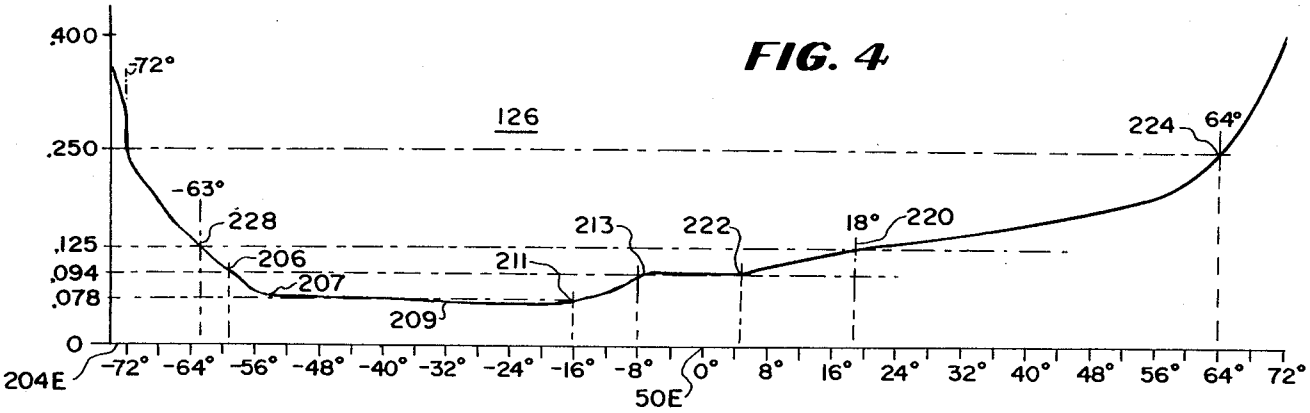
FIG. 4 is a developed view illustrating the operation of the embodiment of FIG. 1.

In FIG. 4 there is shown a developed view or graph 126 illustrating the number of angular degrees through which a roller rotates as plotted against the distance between the first and second surfaces, which determine the amount of compression of a flexible tube in the peristaltic pump. This is expressed by the multiply-curved program line in FIG. 4. The distance between said cam surface and the corresponding location on said guide surface changes from a distance less than twice the thickness of said wall of said tube to the diameter of said tube.

Although it is not described in the foregoing part of the specification, it may be assumed for simplicity that the rollers have backspin forced upon them by some conventional means. Assuming this, no extra compensation in stretching and the extra pulsation due to stretching is necessary. The ordinate at 204E indicates the point a roller contacts a tube prior to being adjacent to a cam surface and the ordinate 228 is where it presses the tube to occlusion between the roller and the cam (second) surface. This period of controlled compression reduces tubing wear and strain on the drive and motion. However, it is not slow enough to eliminate pulsation on the inlet side.

Between the ordinates 228 and 206 a roller proceeds to super-occlude the tube to allow pumping against any head pressure up to 30 psi. At ordinate 206, the tube is flattened and compressed and it remains compressed to point 222 at which time it begins a controlled release from ordinate 222 to ordinate 220. Some pressure is built up between two rollers against the cam surface before the leading roller reaches ordinate 220 to provide for a controlled pressure release while the roller moves further away from the cam surface to ordinate 224, at which time the tube is fully opened. This provides very low pulsation at the end of the tube corresponding to ordinate 224, but not the other end corresponding to ordinate 204E.

Thus, the spacing of an occluded tube which occurs at point 206 is, for many 1/16 inch wall thickness tubes, 0.094 inch or 94 mils and this spacing is maintained to ordinate 222. From ordinate 222 to ordinate 220, the spacing between the rollers and the cam is increased to 0.125 inch gradually and linearly and then it is increased still further to the full outer diameter of the tube which is 0.250 inch. The distance between two adjacent rollers should be at least one-quarter of the length on each side of the hinge connecting the segments of the cam surface and no greater than the total cam length.

The line 209 in FIG. 4 illustrates a method for compensation of the displacement, due to stretching of the tube, between two simultaneously occluding rollers. Stretching occurs if there is no backspin forced on the rollers as is the case with the design illustrated in FIG. 2. In the region between ordinate 207 and 211, the rollers super-occlude the tubing by more than the amount necessary to develop the maximum pressure provided by the pump.

At ordinate 207, the pressure in the liquid trapped ahead of a lagging roller is increased before the over-squeeze necessary for sealing against head pressure is released by the leading roller. The tube on the inlet side already has been closed by the lagging roller at ordinate 206 after the leading roller has passed ordinate 213 where the tube has only enough squeeze to seal against the head pressure, and before the leading roller reaches ordinate 222 where the tube squeeze starts to decrease from an amount sufficient to seal against head pressure.

Figure 5:
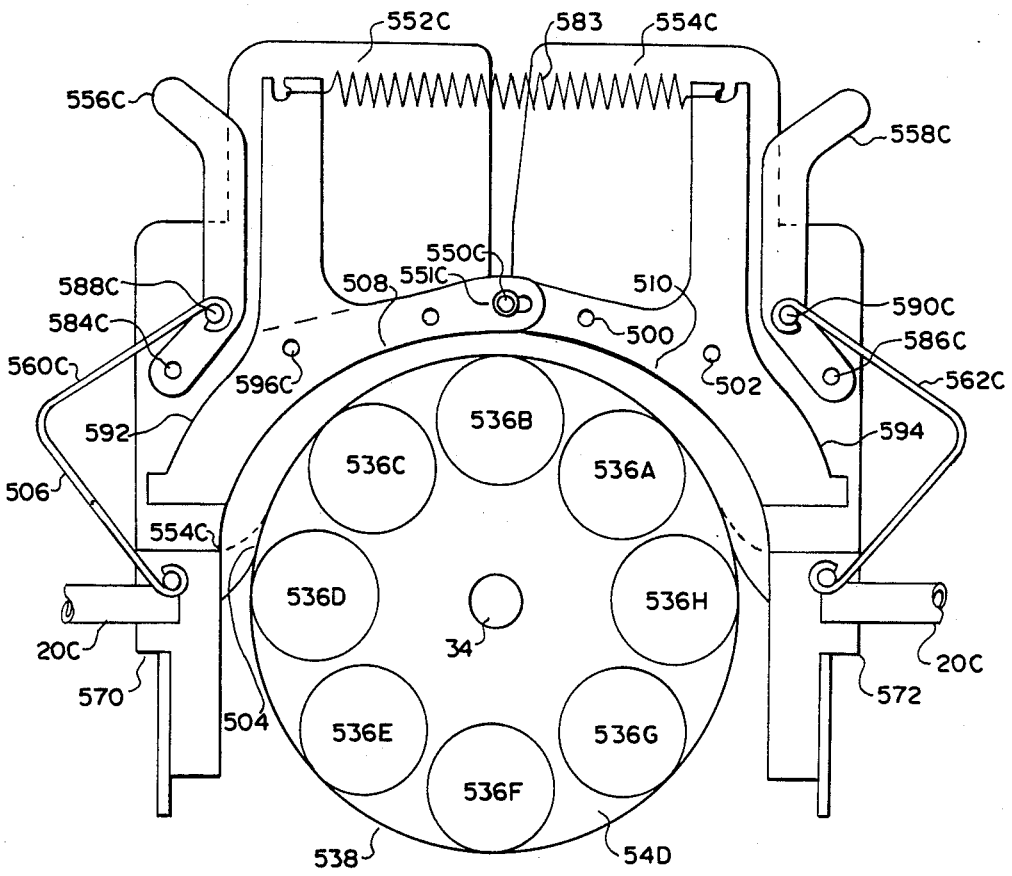
FIG. 5 is an elevational view illustrating another embodiment of a portion of FIG. 1.

FIG. 5 illustrates a way of making a peristaltic pump cassette with four degrees of freedom so up to four rollers may be in contact with its first surface at one time. The fourth degree of freedom is the sliding in-out motion allowed by elongated hole 551C around hinge pin 550C. Coiled tension spring 583 biases the cassette halves together as well as against springs 560C and 562C. The spool 538 of this pump carries eight rollers 536A through 536H, spaced 45 degrees apart, so the program line is compressed with respect to the angular scale shown in FIG. 4. This allows the programmed circumferential length along the first and second surfaces to extend up to any amount less than the distance between five adjacent rollers. This is sufficient to provide a program resulting in very low pulsation at both ends of the tube simultaneously. The developed view or graph of such a program is not difficult to produce, and is more symmetrical than that of FIG. 4. If the rollers have forced backspin, segment 209 will not be required and the programmed space between ordinates 204E and 206 will be similar to a mirror image view of the programmed space between ordinate 222 and an ordinate slightly beyond ordinate 224. The programmed length is sufficient to include the stretch-compensation segment 209 (shown in FIG. 4) since the program line is compressed on the actual program (not shown in FIG. 5).

Generally, the number of degrees of freedom of motion relates to the number of directions of motion permitted for the parts of the cassette with respect to the rollers. This number may be increased by increasing the number of joints in the cassette or the direction of motion at each joint. By increasing the number of degrees of motion, the number of rollers in contact with the cam continuously is increased.

From the above description, it can be understood that the peristaltic pump of this invention has several advantages, such as: (1) it is relatively simple in construction; (2) it can provide relatively pulse-free operation; and (3) it provides a uniform output between different channels of the pump even though they may use the same rollers. It should be understood that the embodiment of FIG. 4 can provide substantially pulse-free operation at the outlet when the roller spool is run in one direction and substantially pulse-free operation at the inlet when the rotor spool is run in the opposite direction. The embodiment of FIG. 5 can provide substantially pulse-free operation at both the inlet and outlet simultaneously, regardless of the direction of roller spool rotation.

Although a preferred embodiment of the invention has been described with some particularity, and two other equally advantageous embodiments have also been described, many modifications and variations of the described embodiments are possible in the light of the above teachings. Therefore, it is to be understood that within the scope of the appended claims, the invention may be practiced other than as specifically described.

What is claimed is:

1. A method of pumping comprising the steps of:

orbiting a plurality of rollers about a drive shaft in a circular orbit;

positioning each of a plurality of flexible tubes in a corresponding one of a plurality of tube supports against a corresponding cam surface wherein each of the tube supports has mounted to it a corresponding guide surface spaced a programmed distance from the cam surface;

resiliently mounting at least some of said guide surfaces against said rollers independently from the other guide surfaces wherein said tubes are compressed to a programmed degree along their lengths and said at least some of said guide surfaces are movable with respect to other of said guide surfaces during pumping.

2. A method of pumping comprising the steps of:

orbiting a plurality of rollers about a drive shaft in a circular orbit;

positioning each of a plurality of flexible tubes in a corresponding one of a plurality of tube supports against a corresponding cam surface wherein each of the tube supports has mounted to it a corresponding guide surface spaced a programmed distance from the cam surface; and resiliently mounting said guide surfaces against said rollers, wherein said tubes are compressed to a programmed degree along their lengths;

the step of resiliently mounting including spring biasing two halves of the tube supports apart at pivotable hinge means.

3. A method of pumping in accordance with claim 2 comprising the step of positioning a guide surface with respect to said rollers so that the rollers are spaced apart at least one-quarter of the length of the shortest guide surface between an end and a hinged point and less than three-quarters of the total length whereby said tube is not compressed until just before it begins releasing the tube near said outlet end.

4. A method of pumping comprising the steps of:

orbiting a plurality of rollers about a drive shaft in a circular orbit;

positioning each of a plurality of flexible tubes in a corresponding one of a plurality of tube supports against a corresponding cam surface wherein each of the tube supports has mounted to it a corresponding guide surface spaced a programmed distance from the cam surface;

resiliently mounting said guide surfaces against said rollers, wherein said tubes are compressed to a programmed degree along their lengths; and positioning a guide surface with respect to said rollers so that the rollers are spaced apart at least one-quarter of the length of the shortest guide surface between an end and a hinged point and less than three-quarters of the total length whereby said tube is not compressed until just before it begins releasing the tube near said outlet end.

5. Apparatus comprising:

a cassette for a peristaltic pump;

said peristaltic pump having rollers;

said cassette having means for receiving at least one peristaltic pump tube and being adapted to cooperate with other cassettes on the same peristaltic pump;

said cassette including means for providing multiple degree of freedom of motion for the cassette with respect to the rollers and other cassettes on the pump while the peristaltic pump operates, whereby the cassette contacts multiple rollers regardless of small errors in the dimensions of the cassette and in the location of the rollers; and said means for providing multiple degrees of freedom of motion for the cassette including a hinge permitting flexing about a central location and spring means for resiliently mounting the ends of the cassette over the rollers.

6. Apparatus in accordance with claim 5 in which the means for providing includes means for providing three degrees of freedom of motion which are: side-to-side, up and down and flexation about said central hinge whereby the cassette contacts at least three rollers simultaneously despite small errors in dimension and location.

7. Apparatus in accordance with claim 5 in which the means for providing includes means for providing four degrees of freedom of motion whereby the cassette contacts at least four rollers simultaneously despite small errors in dimension and location.

8. Apparatus in accordance with claim 5 in which the means for providing includes means for providing multiple degrees of freedom motion whereby the cassette contacts as many rollers as there are degrees of freedom despite small errors in dimension and location.

9. Apparatus in accordance with claim 5 including:

a plurality of tube-holding means;

a plurality of cassettes substantially identical to said first-mentioned cassette, each having a corresponding one of a plurality of said tube-holding means;

each of said tube-holding means including a corresponding one of a plurality of first and second surfaces;

said peristaltic pump tube being a flexible tube;

one of each of said first and second surfaces spacing the corresponding other one of said first and second surfaces from said rollers and the other being a surface adapted to bear against the flexible tube; whereby each of said tube-holding means is movable independently from the other tube-holding means.

10. Apparatus in accordance with claim 9 further including:

a corresponding plurality of spring means for resiliently mounting the ends of each of a corresponding plurality of ends of the corresponding plurality of cassettes over the rollers;

said one of each of said first and second surfaces including a guide surface held against said rollers by said corresponding spring means and having a curvature identical to the curvature of the outer reach of the orbit of said rollers;

said other of said first and second surfaces being shaped to vary in distance from said one of said first and second surfaces in accordance with said controlled sequence of degree of squeezing of the tube by rollers.

11. Apparatus according to claim 10 in which at least some of the tube-holding means are in at least two sections connected by a hinge means, the distance between the first and second surface approximately 90 degrees from the hinge means being substantially equal to the outer diameter of the corresponding tube, said distance becoming less to a point approximately 63 degrees from the hinge means at which point it is substantially twice the thickness of the walls of the tube; at a point between the hinge means and 63 degrees, the distance is less than twice the thickness of the walls of the tube; and from approximately 5 degrees beyond the hinge means to 90 degrees beyond the hinge means the distance becomes successively greater than said distance less than twice the thickness of the tube.

12. Apparatus in accordance with claim 10 in which the distance of the two surfaces from each other with respect to degrees of rotation is substantially as shown in FIG. 4.

13. A cassette in accordance with claim 10 in which the distance of the two surfaces from each other with respect to degrees of rotation is as shown in FIG. 4.

14. A cassette for a peristaltic pump adapted to include at least one flexible tube through which fluid flows having rollers adapted to squeeze said at least one tube to cause pumping of a fluid therethrough, comprising:

at least one tube-holding means for providing a controlled sequence of different degrees of squeezing of said at least one flexible tube by the rollers based on the position of the rollers with respect to the tube-holding means;

said tube-holding means including spring means for biasing said cassette against said rollers; and at least first and second surfaces;

one of said first and second surfaces spacing the other from said rollers;

the other of said first and second surfaces being adapted to bear against a flexible tube;

said spring means being releasable;

said at least one tube-mounting means including first mounting and second mounting means;

said first and second mounting means being pivoted at a central location; and said spring means including at least one biasing means for resiliently and releasably biasing said first and second mounting means against said rollers and at least a second biasing means for resiliently biasing said first and second mounting means apart.

15. A peristaltic pump comprising:

a motor;

a drive shaft for said motor having a drive shaft axis;

first and second flanges mounted orthogonally to said drive shaft for rotataion therewith;

a plurality of rollers rotatably mounted to said flanges for orbiting about the axis of said drive shaft while being free to rotate in said flanges about their axes;

a tube holding means;

said tube holding means having mounted to it a cam surface means having a cam surface adapted to receive a tube;

spring means for mounting said tube holding means to said peristaltic pump;

a guide surface means having a guide surface;

said cam surface being spaced from said rollers by said guide surface;

said guide surface means being connected to the cam surface means;

a flexible tube having a length and a flexible wall;

said tube corresponding in position along a portion of its length to the cam surface;

said tube holding means including at least one inlet and outlet tube holding means and said spring means including at least one means for spring biasing said inlet and outlet tube holding means and at least one pivoted hinge means;

said cam surface means including inlet cam means mounted to said inlet tube holding means and outlet cam means mounted to said outlet tube holding means;

said guide surface and plurality of rollers having dimensions such that successive rollers contact at least one-quarter of the guide surface between one end of the guide surface and the pivoted hinged means and less than three-quarters of the total guide surface whereby said tube is not compressed by each of said successive rollers until just before said each of said successive rollers begins releasing the tube near said outlet end; and the distance between said cam surface and the corresponding location on said guide surface changing from a distance less than twice the thickness of said wall of said tube to the diameter of said tube.

16. A peristaltic pump in accordance with claim 15 in which:

said tube holding means includes a plurality of tube holding stations;

said cam surface means includes a plurality of cam surfaces each cooperating with a different tube holding station and being adapted to receive a tube;

said spring means for mounting said tube holding means including a plurality of spring means for mounting said tube holding stations to said peristaltic pump;

each of said means for mounting including a cam surface spaced from said rollers by a guide surface connected to the cam surface;

a plurality of flexible tubes each having a different one of a corresponding plurality of flexible walls;

each of said tubes corresponding to a different cam surface means; and each of said tube holding means including inlet and outlet tube holding means, spring means for biasing said inlet and outlet tube holding means against said rollers.

17. A peristaltic pump in accordance with claim 15 in which the spring means includes means for imparting two degrees of freedom to the tube holding means, which are up-down and side-to-side motion, and the pivoted hinge means impart a third degree of motion to the tube holding means, which is pivoting rotation about the hinge.

18. A peristaltic pump in accordance with claim 17 in which the hinge means imparts a fourth degree of motion to the tube holding means, which is sliding away and toward the hinge.

19. A peristaltic pump in accordance with claim 18 whereby the four degrees of freedom allow the guide surface to contact four rollers simultaneously.

20. A peristaltic pump in accordance with claim 17 whereby the three degrees of freedom allow the guide surface means to contact three rollers simultaneously.

21. A peristaltic pump in accordance with claim 20 in which said quide surfaces and a plurality of rollers have dimensions such that successive rollers contact at least one-eighth of the total lengths of guide surface whereby said tube is not completely compressed until just before it begins releasing the tube near said outlet end.

22. A peristaltic pump for pumping fluids through a plurality of tubes comprising:

a drive shaft;

a plurality of rollers mounted to said drive shaft for orbiting thereabout;

a plurality of tube holding means;

a plurality of cam surface means each having a corresponding cam surface;

each of such tube holding means having mounted to it a corresponding one of said cam surface means adapted to receive a corresponding tube of said plurality of tubes on a corresponding one of said cam surfaces;

a plurality of spring means for mounting said tube holding means with at least some of said tube holding means being movable with respect to others of said tube holding means while said peristaltic pump is operating to pump fluids, whereby said cam surfaces are independently self-adjusting;

a plurality of guide surface means each having a different one of a plurality of guide surfaces;

each of said cam surfaces being spaced from said rollers by a corresponding one of said guide surfaces incorporated in the tube holding means, whereby the amount each of said tubes of said plurality of tubes is squeezed by said rollers depends upon the distance between its corresponding guide surface and cam surface; and said distance between corresponding guide surfaces and cam surfaces differing at different positions along the guide surfaces so as to provide a controlled sequence of degree of squeezing of the tubes by rollers based on the position of the rollers along corresponding guide surfaces.

23. A peristaltic pump according to claim 22 in which said tube holding means and spring means include cooperating release means wherein at least some of said tube holding means may be removed from said peristaltic pump while said peristaltic pump is operating to pump fluids through tubes in others of said tube holding means.

24. A peristaltic pump for pumping fluids through a plurality of tubes comprising:

a drive shaft;

a plurality of rollers mounted to said drive shaft for orbiting thereabout;

a plurality of tube holding means;

a plurality of cam surface means each having a corresponding cam surface:

each of said tube holding means having mounted to it a corresponding one of said cam surface means adapted to receive a corresponding tube of said plurality of tubes on a corresponding one of said cam surfaces;

a plurality of spring means for mounting said tube holding means;

a plurality of guide surface means each having a different one of a plurality of guide surfaces; and each of said cam surfaces being spaced from said rollers by a corresponding one of said guide surfaces incorporated in the tube holding means, whereby the amount each of said tubes of said plurality of tubes is squeezed by said rollers depends upon the distance between its corresponding guide surface and cam surfaces;

said distance between corresponding guide surfaces and cam surfaces differing at different positions along the guides surface so as to provide a controlled sequence of degree of squeezing of the tubes by rollers based on the position of the rollers along corresponding guide surfaces;

each of said spring means; including inlet and outlet spring biasing means for biasing said tube holding means toward said rollers; and spring-biased pivotable hinge means for biasing said tube holding means away from said rollers;

said inlet and outlet spring biasing means including at least a first spring and said spring-biased pivotable hinge means including at least a second spring said first spring being stiffer than said second spring.

25. A peristaltic pump in accordance with claim 24 in which said guide surfaces and plurality of rollers have dimensions such that successive rollers contact at least one-eighth of the total length of said guide surfaces and less than three-quarters of the total length of the guide surface whereby said tube is not completely compressed until just before it begins releasing the tube near said outlet end.

* * * * *

UNITED STATES PATENT AND TRADEMARK OFFICE

CERTIFICATE OF CORRECTION

PATENT NO. : 4,673,334

DATED : June 16, 1987

INVENTOR(S) : Robert W. Allington; John D. Hull

It is certified that error appears in the above-identified patent and that said Letters Patent is hereby corrected as shown below:

IN THE ABSTRACT:

Line 9, change "rolles." to --rollers.--.

IN THE SPECIFICATION:

Column 1, line 18, change "crosssectional" to --cross-sectional--.

Column 1, line 22, change "crosssectional" to --cross-sectional--.

Column 4, line 26, change "adpated" to --adapted--.

Column 7, line 37, change "time." to --time--.

IN THE CLAIMS:

Column 11, line 19, change "degree" to --degrees--.

Column 12, line 64, change "rotataion" to --rotation--.

Column 13, line 26, change "hinged" to --hinge--.

Column 15, line 12, change "guides surface" to --guide surfaces--.

Signed and Sealed this

Third Day of November, 1987

*Attest:*

DONALD J. QUIGG

*Attesting Officer* *Commissioner of Patents and Trademarks*